US010443207B2

(12) United States Patent
Revel-Muroz et al.

(10) Patent No.: US 10,443,207 B2
(45) Date of Patent: Oct. 15, 2019

(54) PILE FOUNDATIONS FOR SUPPORTING POWER TRANSMISSION TOWERS

(71) Applicants: Public Joint Stock Company "Transneft", Moscow (RU); Joint-stock company "Transneft Siberia", Tyumen (RU); L.L.C. "Transneft Research and Development Institute for Oil and Oil Products Transportation", Moscow (RU)

(72) Inventors: Pavel Aleksandrovich Revel-Muroz, Moscow (RU); Nikolai Vladimirovich Smirnov, Ostrovtsy (RU); Vitaly Aleksandrovich Kumallagov, Moscow (RU); Evgenii Evgenievich Semin, Moscow (RU); Alexandr Vladimirovich Ivakin, Moscow (RU); Yury Vasilevich Bogatenkov, Tyumen (RU)

(73) Assignees: PUBLIC JOINT STOCK COMPANY "TRANSNEFT", Moscow (RU); JOINT-STOCK COMPANY "TRANSNEFT SIBERIA", Tyumen (RU); L.L.C. "TRANSNEFT RESEARCH AND DEVELOPMENT INSTITUTE FOR OIL AND OIL PRODUCTS TRANSPORTATION", Moscow (RU)

( * ) Notice: Subject to any disclaimer, the term of this patent is extended or adjusted under 35 U.S.C. 154(b) by 130 days.

(21) Appl. No.: 15/226,870

(22) Filed: Aug. 2, 2016

(65) Prior Publication Data

US 2016/0340857 A1 Nov. 24, 2016

Related U.S. Application Data

(63) Continuation of application No. PCT/RU2014/000210, filed on Mar. 28, 2014.

(51) Int. Cl.
*E02D 31/14* (2006.01)
*E02D 27/35* (2006.01)
(Continued)

(52) U.S. Cl.
CPC ..... *E02D 31/14* (2013.01); *E02D 5/30* (2013.01); *E02D 5/60* (2013.01); *E02D 27/12* (2013.01); *E02D 27/35* (2013.01)

(58) Field of Classification Search
CPC combination set(s) only.
See application file for complete search history.

(56) References Cited

U.S. PATENT DOCUMENTS 3,217,791 A 11/1965 Long
3,370,998 A * 2/1968 Wiswell, Jr. ..... E02D 5/226 156/212

(Continued)

FOREIGN PATENT DOCUMENTS

CA 2540185 3/2005
CN 2148777 12/1993

(Continued)

OTHER PUBLICATIONS

G. Ya. Bulatov, et al.; "*Technology of erecting the foundations—"pile in pipe"*"; Civil Engineering Magazine, 2008, No. 1, pp. 33-37; (10 pages).

(Continued)

*Primary Examiner* — Sean D Andrish
(74) *Attorney, Agent, or Firm* — One LLP; Jonathan Jaech

(57) ABSTRACT

Pile foundations for power transmission towers or the like for installation in different types of soil prone to frost heaving include a casing pipe and a dipped pile, comprising a shaft and a toe bulb, secured at the bottom of the shaft. The pile comprises rigid elements that are mounted on the shaft (Continued)

in the direction of horizontal forces acting on the pile against the anticipated horizontal loads. The rigid elements transfer horizontal forces from the pile to the casing pipe.

19 Claims, 1 Drawing Sheet

(51) Int. Cl.
*E02D 5/30* (2006.01)
*E02D 5/60* (2006.01)
*E02D 27/12* (2006.01)

(56) References Cited

U.S. PATENT DOCUMENTS

| | | | | |
|---|---|---|---|---|
| 3,630,037 | A | 12/1971 | Howard | |
| 3,706,204 | A | 12/1972 | Long | |
| 3,788,389 | A | 1/1974 | Waters | |
| 3,820,347 | A * | 6/1974 | Medema | E02D 5/30 405/232 |
| 3,832,857 | A | 9/1974 | Bassett | |
| 3,839,874 | A | 10/1974 | Wyant | |
| 3,881,320 | A | 5/1975 | Gendron | |
| 3,921,410 | A | 11/1975 | Philo | |
| 3,946,569 | A | 3/1976 | Stuber | |
| 4,121,427 | A | 10/1978 | Tuttle | |
| 4,585,681 | A | 4/1986 | Kidera et al. | |
| 4,669,918 | A | 6/1987 | Riles | |
| 4,707,956 | A * | 11/1987 | Sato | E02D 5/38 52/167.4 |
| 4,723,876 | A | 2/1988 | Spalding et al. | |
| 4,818,148 | A * | 4/1989 | Takeda | E02D 5/60 405/216 |
| 5,016,711 | A | 5/1991 | Cowan | |
| 5,219,249 | A | 6/1993 | Junsheng et al. | |
| 5,661,932 | A | 9/1997 | Barefield | |
| 6,231,270 | B1 * | 5/2001 | Cacossa | E02D 5/32 175/424 |
| 6,309,142 | B1 | 10/2001 | Takeda et al. | |
| 6,665,990 | B1 | 12/2003 | Cody et al. | |
| 7,533,505 | B2 | 5/2009 | Henderson | |
| 8,376,659 | B2 | 2/2013 | Baugh | |
| 8,608,409 | B2 | 12/2013 | Collina et al. | |
| 2009/0110540 | A1 * | 4/2009 | Bywaters | F03D 7/0296 415/47 |
| 2012/0107053 | A1 | 5/2012 | Baumfalk | |
| 2014/0352449 | A1 | 12/2014 | Hale et al. | |
| 2016/0017562 | A1 | 1/2016 | Barron et al. | |

FOREIGN PATENT DOCUMENTS

| | | |
|---|---|---|
| CN | 2695482 | 4/2005 |
| CN | 201087402 | 7/2008 |
| CN | 101899830 | 12/2010 |
| CN | 102041814 | 5/2011 |
| CN | 103147435 | 6/2013 |
| CN | 104278690 | 1/2015 |
| CN | 105672321 | 6/2016 |
| CN | 105672344 | 6/2016 |
| DE | 3228198 | 2/1984 |
| EP | 1046753 | 10/2000 |
| EP | 2672012 | * 11/2013 |
| JP | 61-134425 | 6/1986 |
| JP | 02183006 | * 7/1990 |
| JP | 5222723 | 8/1993 |
| RU | 793752 | 4/1995 |
| RU | 2091541 | 9/1997 |
| RU | 2295006 | 3/2007 |
| RU | 2295007 | 3/2007 |
| RU | 2303103 | 4/2007 |
| RU | 85171 | 7/2009 |
| RU | 2386749 | 4/2010 |
| RU | 118324 | 7/2012 |
| RU | 2474652 | 2/2013 |
| RU | 2027827 | 2/2015 |
| RU | 2556588 | 7/2015 |
| RU | 2556589 | 7/2015 |
| WO | 2008091173 | 7/2008 |

OTHER PUBLICATIONS

Permafrost Technology Foundation, "Design Manual for New Foundations on Permafrost", 2000.

S.B. Ukhov et al.; "Soil mechanics, bases and foundations" ASV Publishing House, 1994, p. 405; (6 pages).

Lyazgin, A.L. et al; "*Stabilization of Pile Foundations Subjected to Frost Heave and in Thawing Permafrost*"; Swets & Zeitlinger, Lisse, 2003, pp. 707-711; (5 pages).

Kondrat'ev, V.; "*Strengthening of Supports for Contact Systems and Overhead Transmission Lines Erected on Heaving Seasonally Thawing Soils*"; Soil Mechanixs & Foundation Engineering, vol. 41 Issue 5, Sep. 2004; (1 page).

Niranjan, Kapil Kant; "*Pile-Foundation*"; Anad Engineering College, Civil Engineering Dept., Agra; (30 pages).

* cited by examiner

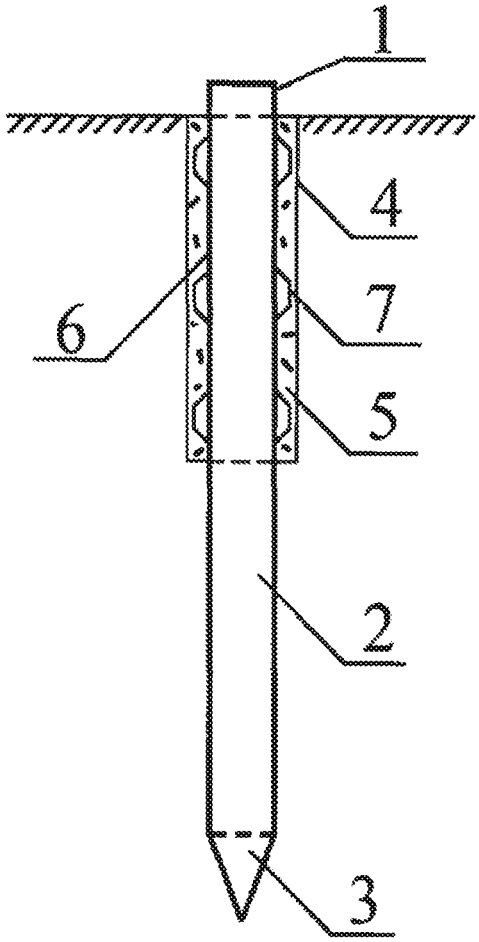
1
4
6
7
5
2
3

PILE FOUNDATIONS FOR SUPPORTING POWER TRANSMISSION TOWERS

CROSS-REFERENCE TO RELATED APPLICATION

This application claims the benefit and priority of PCT Pat. App. No. PCT/RU2014/000210, titled PILE FOUNDATION FOR SITUATING SUPPORTS OF OVERHEAD POWER TRANSMISSION LINES filed on Mar. 28, 2014, also published as WO/2015/147675.

FIELD

The present disclosure relates to the field of energy and particularly to pile foundations of power transmission towers installed in different types of soil. The invention may be used in construction and repair of pile foundations of power transmission towers, and in other industries, where piles bear horizontal loads and accommodate frost heaving of the soil.

BACKGROUND

Driven piles are used to support power transmission lines and other structures that impose vertical and horizontal loads. Various configurations of driven piles are known in the art. There is a configuration of drilled-in pile comprising a cylindrical shaft made of metal, with a tip connected by butt welding to the end of the cylindrical shaft, and with the cylindrical shaft covered with anticorrosion coating (patent RU No. 123795, IPC E02D5/22).

There is a configuration of piles with increased reliability against the effects of frost heaving of the soil on the pile, comprising a cast-in-situ reinforced concrete shaft, concreted in the hole, with a metal casing in the area of influence of frost soil heaving, whose cross-section is less than the cross section of the hole. The casing has an anti-heaving coating on the outer surface. The casing is not attached to the fixture of the pile, and the space between the casing and the hole walls is filled with hydrophobic soil (patent RU No. 118324, IPC E02D5/60).

The disadvantage of the above installations is insufficient bearing capacity against horizontal loads and inability to exclude the impact of frost heaving.

There is a configuration of driven pile comprising a shaft with a longitudinal hole in it, a pointed tip, and a device that increases the bearing capacity of the pile. The bottom of the shaft has a recess with a cylindrical surface, an elastic coating with the tools fastening its upper and lower ends, which covers the cylindrical surface of the recess; a space between the elastic coating and the cylindrical surface of the recess; protective housing extendible in radial axis with its fastening tools on the shaft, and covering the elastic coating. The shaft has a radial hole connecting the longitudinal hole with the above cavity, transformed in a supporting skirt after immersing the pile to a predetermined depth, filling the cavity with hardening mortar through the holes in the shaft and mortar hardening (patent RU No. 85171, IPC E02D5/48). However, fabrication of such a pile structure requires much labor for manufacturing and as a consequence an increased time of the work.

There is a configuration of driven pile comprising a shaft with a longitudinal through hole, a pointed tip, a device increasing the bearing capacity of the pile, positioned between the shaft and the tip in a form of an insert with a longitudinal hole; attached to them, having the elastic coating with the tools to fasten its upper and lower ends, and covering the cylindrical surface of the insert. The cavity between the elastic coating and the cylindrical surface of the insert, a housing extendible in radial axis with its fastening tools on the shaft, covering the elastic coating. The shaft has a radial hole connecting the longitudinal hole with the cavity, transformed in a supporting skirt after immersing the pile to a predetermined depth, filling the cavity with hardening mortar through the holes in the shaft and mortar hardening. The pile shaft may be prismatic or cylindrical, and the tip may be conical, pyramidal or wedge-shaped. The pile has high bearing capacity with reduced power of immersion into the soil (patent RU No. 2386749, IPC E02D5/48). However, this pile design has low bearing capacity when subjected to horizontal forces on the pile, and under the action of wind loads on poles and wires.

Another configuration of piles, in the construction of the pile foundations for resisting major vertical and horizontal loads, includes combined vertical and inclined shafts, with reinforcement cages that increase the stability of the vertical piles by braces and anchors of augercast piles (patent RU No. 2303103, IPC E02D5/46). The disadvantage of this configuration is difficulty and complexity of implementation of this installation, the inability to eliminate the impact of frost heaving forces, and the high cost of the work.

There is a technology of erection of foundations named "pile in pipe" (G. Ya. Bulatov, A. Yu. Kostyukova, Civil Engineering Magazine. 2008. No. 1, p. 33-37). This technology consists in the following: after immersing a pipe pile, soft ground is being removed from its cavity, soil plug surface is being leveled, soil plug is being compacted, then a layer of drainage material with seal is being put, after that a foundation pile is being installed to transmit the load from the pilework to the soil plug. However, this design does not have high bearing capability under the action of horizontal forces on the pile.

There is a method of constructing a pile foundation (ref. to Canadian patent No. 2540185, published on 31 May 2005, IPC E02D27/12), according to which at least one metal pile is inserted via a through hole, then it is axially fixed in structure, comprises a bar and at least one lower primary head in contact with the ground; the transverse dimensions of the head are greater than those of the hole. The disadvantage of this invention is an insufficient bearing capacity against horizontal loads It would be desirable, therefore, to develop new configurations for driven piles that are capable supporting horizontal and vertical loads in soils subject to frost heaving, while being more economical in materials and installation costs.

SUMMARY

This summary and the following detailed description should be interpreted as complementary parts of an integrated disclosure, which parts may include redundant subject matter and/or supplemental subject matter. An omission in either section does not indicate priority or relative importance of any element described in the integrated application. Differences between the sections may include supplemental disclosures of alternative embodiments, additional details, or alternative descriptions of identical embodiments using different terminology, as should be apparent from the respective disclosures.

In an aspect of the disclosure, a driven pile inside a casing pipe and load coupled to the casing pipe using rigid elements attached the shaft that act on a fill material inside the casing. The casing is buried from the soil line to below the frost line.

The technical result is to increase the reliability of the pile bearing capacity against horizontal loads, reduce labor content and the cost of fabrication and installation, and increase the reliability against the impact of frost heaving forces of the soil on the pile.

The pile foundation for configuration of power transmission towers has a casing pipe and a dipped pile, comprising a shaft and a toe bulb, secured at the bottom of the shaft. The pile comprises rigid elements that are mounted on the shaft in the direction of horizontal forces acting on the pile (for example, against loads from the overhead line wires which serve to transfer horizontal forces from the pile to the casing pipe). The rigid elements are disposed on the shaft vertically spaced apart by not less than the length of each rigid element.

The foundation has an additional cutoff screen mounted on the pile from its upper part to the level of seasonal freezing and thawing of soils, which can be made of plastic film or plastic sheet or galvanized metal sheet.

Rigid elements (stiffeners) are flat, square, triangular, or round in shape. The structural elements may be 5-15 cm long, 0.5-2 cm wide, and 2-10 cm high. Rigid elements are positioned on the opposite side of the pile in one plane.

The pile shaft is made of concrete, steel, or reinforced concrete. The pile toe bulb is conical or spherical or flat in shape and fixed by welding or molded as a single monolithic structure.

The pile may have rectangular or circular cross-section. Distinctive features of the proposed pile include the manner of attachment of the casing to the shaft using the rigid elements and fill material, and other features To the accomplishment of the foregoing and related ends, one or more examples comprise the features hereinafter fully described and particularly pointed out in the claims.

BRIEF DESCRIPTION OF THE DRAWINGS

The features, nature, and advantages of the present disclosure will become more apparent from the detailed description set forth below when taken in conjunction with the drawings.

FIG. 1 is a schematic diagram illustrating a foundation pile with the casing pipe and rigid elements.

DETAILED DESCRIPTION

Various aspects are now described with reference to FIG. 1, wherein the following components are illustrated: 1—pile, 2—pile shaft, 3—pile toe bulb, 4—casing pipe, 5—filler, 6—cutoff screen, 7—rigid elements. Pile 1 comprises a shaft 2 and toe bulb 3. The pile shaft 1 may be made of concrete of grade B10-B40, of metal roll with 17G1S, 17G1S-U, St2kp, St2ps, St2sp, St3kp, St3ps, St3sp, St3ps3, St3sp3, St3ps4, St3sp40, or 9G2S steel grade, K34-K60 strength class, or reinforced concrete. The pile shaft 2 may have a length of $L_1$, for example, in a range of 6-20 m, and a cylindrical shape with a diameter $d_1$, for example, in a range of 15-150 cm. In an alternative, the pile shaft 2 may be rectangular in cross section with sides of dimension, for example, in a range of 10-100 cm by 10-100 cm. The pile shaft 2 serves to accommodate vertical, horizontal and other loads. The bottom of the pile shaft 2 may be attached with a pile toe bulb 3, which may be tapered, rounded or flat in shape and mounted to the shaft 2 by welding or molded as a single monolithic structure, in the case of configuration of concrete and reinforced concrete piles.

The top of the shaft 2, which is 1 m to ½ m long, may be attached with a cutoff screen 6 and rigid elements 7. The cutoff screen 6 may be made of plastic sheet or metal galvanized sheet. The cutoff screen 6 is installed close to the shaft 2 and fixed to it using clamps before or during driving the pile 1. The cutoff screen 6 is used to separate the pile 1 from the filling material in order to increase the reliability against the impact of frost heaving of the soil on the pile 1.

Rigid elements 7 of the shaft 2 may be made of metal plates with 09G2S, 10G2, 15GS, 16GS, 17GS steel grade, for example, in a range of 1-50 cm long, 1-20 cm wide, and 0.1-5 cm thick. Rigid elements 7 may comprise a generally flat plate having a shape of square, triangular, circular or other non-arbitrary geometric shape. Rigid elements 7 are installed transverse to the anticipated horizontal forces acting on the pile 1, for example, horizontal forces from transmission lines. As shown in FIG. 1, the rigid elements may be attached in pairs on opposite sides of the shaft 2. The rigid elements 7 may be attached to the shaft 2 by welding vertically spaced apart by not less than the length of the rigid elements. Rigid elements 7 serve to transfer horizontal forces of the pile on the casing pipe 4.

The pile shaft 2 is mounted into the casing pipe 4. The casing pipe 4 may be made of pipe metal-roll with 17G1S, 17G1S-U, St2kp, St2ps, St2sp, St3kp, St3ps, St3sp, St3ps3, St3sp3, St3ps4, St3sp40, 9G2S steel grade, K34-K60 strength class, with $L_2$ length, for example, in a range of 1-10 m, with a diameter $d_2$, for example, in a range of 20-200 cm. The casing pipe 4 serves to accommodate horizontal loads from the pile 1 and transfer them to the surrounding soil with a larger work area. The filler 5 of the space between the pile 1 and the casing pipe 4 is cement and sand mortar of M100-M350 grade, or B10-B40 grade concrete, or loose inert non-frost heaving material.

The pile foundation may be installed as follows: A pilot hole for the pile may first be drilled, then the casing pipe 4 may be immersed into the soil by driving in around the pilot hole. Sinking of the casing pipe may be followed by drilling out the soil inside the casing pipe to a depth of immersion of the casing pipe. After drilling out the soil, the pile 1 may be driven in to design marks, for example, to a depth as shown in FIG. 1. Then the cavities between the pile 1 and the casing pipe 4 may filled with the filler 5, for example, with soil, or cement and sand (e.g., mortar or concrete). When using rigid elements 7 to transfer forces from the pile 1 to the casing pipe 4, before driving the pipe, rigid elements 7 may be mounted on the pile 1 followed by driving the pile 1 and filling the cavity between the pile 1 and the casing pipe 4.

When mounting driven piles, drilling of the pile pilot hole is followed by the immersion of the casing pipe in the soil by driving it in, with the subsequent drilling out the soil inside the casing pipe to a depth of immersion of the casing pipe. After drilling out the soil, the pile is driven in the pilot hole up to design marks, and the cavities between the pile and the casing pipe are filled with soil or with cement and sand mortar (concrete). When using rigid elements to transfer forces from the pile to the casing pipe, before driving the pipe, rigid elements are mounted on the pile followed by the pile driving and filling the cavities between the pile and the casing pipe.

The invention claimed is:

1. A pile foundation for supporting horizontal and vertical loads in substrates susceptible to frost heaving, the pile foundation comprising:

a casing pipe;

an immersed pile comprising a shaft and a toe bulb secured at the bottom of the shaft, positioned in the casing pipe; and rigid elements each comprising a generally flat plate directly mounted on the shaft transverse to horizontal forces from transmission lines acting on the pile and configured for transferring the horizontal forces from the pile to the casing pipe, the rigid elements arranged in pairs wherein the rigid elements are fixed on opposite sides of the shaft from one another and in a common plane transverse to the horizontal forces from the transmission lines.

2. The pile foundation of claim 1, wherein each of the rigid elements is disposed on the shaft and spaced apart by not less than the length of each of the rigid elements.

3. The pile foundation of claim 1, further comprising a cutoff screen mounted on the shaft from an upper part of the shaft to a level of seasonal freezing and thawing of soils.

4. The pile foundation of claim 3, wherein the cutoff screen comprises a plastic film or sheet.

5. The pile foundation of claim 3, wherein the cutoff screen comprises a galvanized metal sheet.

6. The pile foundation of claim 3, wherein the cutoff screen is fixed to the shaft using clamps.

7. The pile foundation of claim 1, wherein each of the rigid elements has a shape selected from square, triangular, and circular.

8. The pile foundation of claim 1, wherein the pile shaft is made of one of concrete, steel, or reinforced concrete.

9. The pile foundation of claim 1, wherein the pile toe bulb has a shape selected from tapered, circular, and flat.

10. The pile foundation of claim 1, wherein the toe bulb is secured by welding to the shaft.

11. The pile foundation of claim 1, wherein the toe bulb is secured by being molded as a single monolithic structure with the shaft.

12. The pile foundation of claim 1, wherein the casing is buried to a depth greater than a level of seasonal freezing and thawing of soils.

13. The pile foundation of claim 1, wherein a space between the casing and the shaft is filled with an inert non-heaving material.

14. The pile foundation of claim 13, wherein each of the rigid elements comprises a steel material.

15. The pile foundation of claim 13, wherein each of the rigid elements is in the range of 1-50 cm long, 1-20 cm wide, and 0.1-5 cm thick.

16. The pile foundation of claim 13, wherein each of the rigid elements is welded to the shaft.

17. The pile foundation of claim 13, wherein the shaft comprises a steel material.

18. The pile foundation of claim 1, wherein a space between the casing and the shaft is filled with one of concrete and mortar.

19. The pile foundation of claim 18, wherein the space between the casing pipe and the shaft is filled with one of an M100-M350 grade mortar and a B10-B40 grade concrete.

* * * * *